US005934442A

United States Patent [19]

Rappold et al.

[11] Patent Number: 5,934,442

[45] Date of Patent: Aug. 10, 1999

[54] PROCESS FOR SEPARATING WIRES OF A WIRE BUNDLE

[75] Inventors: Dietmar Rappold, Dietikon, Germany; Robert Meier, Wettswil, Switzerland

[73] Assignee: H.A. Schlatter AG, Schlieren, Switzerland

[21] Appl. No.: 08/800,178

[22] Filed: Feb. 13, 1997

[30] Foreign Application Priority Data

Nov. 9, 1996 [CH] Switzerland ..... 2222/96

[51] Int. Cl.[6] ..... B65G 47/12

[52] U.S. Cl. ..... 198/455; 198/453; 198/454

[58] Field of Search ..... 198/453, 454, 198/455, 443

[56] References Cited

U.S. PATENT DOCUMENTS

| | | | |
|---|---|---|---|
| 1,236,019 | 8/1917 | Tzbibides | 198/454 |
| 1,252,562 | 1/1918 | Fassinger | 198/453 |
| 2,661,830 | 12/1953 | Total | 198/454 |
| 3,298,564 | 1/1967 | Wheatley et al. | 198/455 |
| 3,323,633 | 6/1967 | Engel et al. | 198/455 |
| 3,744,616 | 7/1973 | Guillemette | 198/453 |
| 3,985,252 | 10/1976 | Hinchcliffe et al. | 198/454 |
| 4,063,633 | 12/1977 | Hall | 198/455 |
| 4,353,678 | 10/1982 | Gott et al. | 198/454 |
| 5,377,812 | 1/1995 | Oohara | 198/455 |

FOREIGN PATENT DOCUMENTS

| | | | |
|---|---|---|---|
| 166232 | 10/1982 | Japan | 198/453 |

*Primary Examiner*—William E. Terrell
*Assistant Examiner*—Khoi H. Tran

[57] ABSTRACT

In a process for separating wires of a wire bundle the latter is delivered onto feed plane (3) which is sloped in feed direction (3) so that it or the wires move under the action of gravity onto guide element (6) with a control gap. The control gap has a gap width corresponding to the wire diameter and is made to hold the separated wires in the form of a single wire layer. Before the wire bundle can reach the control gap, it is handled using several handling elements (8.1, 8.2, 9.1, 9.2, 10.1, 10.2) located next to one another. They have a strike edge parallel to the feed plane and a scraping edge pointed against the wire bundle, and they execute a striking motion which is such that in the first cycle segment the strike edge, proceeding from the starting point, is guided opposite feed direction (5) over the single wire layer just formed and in a second cycle segment the strike edge is raised from the wire layer in order to be returned to the starting point. Handling elements (10.1, 10.2) which lie farther to the outside follow in phase behind those farther to the inside. To separate wires with especially small diameter:length ratios, two rejectors (7.1, 7.2) can also be provided which execute linear motion at a constant distance to feed plane (3) without touching single wire layer (14). In doing so the amplitude of motion of rejectors (7.1, 7.2) is much greater than that of handling elements (8.1, 8.2, 9.1, 9.2, 10.1, 10.2).

28 Claims, 3 Drawing Sheets

(2-2)

(3-3)

(4-4)

PROCESS FOR SEPARATING WIRES OF A WIRE BUNDLE

TECHNICAL FIELD

The invention relates to a process for separating wires of a wire bundle or similar long, thin bundled objects, in which the wire bundle is delivered onto a feed plane which is sloped in the feed direction, so that the wires can move under the action of gravity onto a guide element with a control gap which has a width corresponding to the wire diameter and which is made to hold the separated wires in the form of a single wire layer. The invention furthermore relates to a device for implementing the process.

DESCRIPTION OF THE RELATED ART

In lattice welding machines which operate with wires of a prefabricated length it is necessary to separate the wires which are delivered as bundles. The speed and reliability of separation can contribute greatly to the production performance of the welding machine.

Devices for separating wires are inherently prior art. In practice, however, it happens that the known devices work well only for thick (relative to length) wires. For long, thin wires on the other hand (i.e., when the length is for example 1000 times the diameter, or more) problems occur. Due to the high flexibility of the prefabricated wire pieces, their ends can move freely and easily cross.

DESCRIPTION OF THE INVENTION

The object of the invention is to devise a process of the initially mentioned type which is suitable for separation of long, thin wires. It should be possible to mechanize the process with minimum technical cost.

According to the invention, therefore, the wire bundle, before it can reach the control gap, is handled with several handling elements located next to one another. The handling elements have a strike edge parallel to the feed plane and a scraping edge pointed against the wire bundle, and execute a striking motion which is such that in the first cycle segment the strike edge, proceeding from the starting point, is guided opposite the feed direction over the single wire layer just formed or being formed and in a second cycle segment is raised from the wire layer in order to be returned finally to the starting point.

In the first cycle segment, all those wires which project above the level defined by the single wire layer are pushed back by the scraping edge to the wire bundle. The raising of the handling elements in the second cycle segment makes it possible to subsequently remove the wires which are crossing and therefore improperly arranged. When a wire is raised up (due to the existing, even if low bending strength) from the single-layer level it can be acquired by the scraping edge during the next strike movement and returned to the wire bundle (since it is at least briefly skipped by the other handling elements).

For the purposes of one preferred embodiment, two handling elements are located immediately next to one another and operated such that their movements are phase-shifted by 180° relative to one another. Thus, the strike phase can be made relatively long and the skip phase (in which the strike edge freely delivers the wire layer) can be made relatively short without the handling elements needing to vary their speed of motion within one cycle. Of course, it is also conceivable that, for example, three handling elements could work directly next to one another with a suitable phase shift (of, for example, 120°).

According to one especially preferred embodiment, several handling elements or groups of handling elements are distributed over the entire width of the feed plane (i.e., the length of the wires) and are driven in different phases. In particular, handling elements which are located farther to the outside (i.e., nearer the edge of the feed plane) have motion delayed relative to the elements which are located further to the inside. The phase delay is, for example, 120°. It should be noted that this phase delay has nothing to do with the phase difference between the handling elements within a handling unit.

There can be rejectors next to the control gap, preferably between the innermost handling element and the control gap. They execute a return motion with an amplitude in the feed direction which is larger (typically by a multiple) than that of the handling elements. In contrast to handling elements, the rejector moves at a constant distance to the feed plane.

In this way wires which are crossed in the wire layer in front of the control gap can be completely withdrawn and rejected. For correct operation of the rejectors it is important that the handling elements have a cycle segment in which they are completely raised from the wire layer. But it should not be said that all handling elements have to be raised at the same time. It is quite enough that each element or each element group locally releases the wire to be returned for a short time.

According to one advantageous embodiment of the present invention exactly two rejectors are provided. They are operated in a synchronous stroke or counterstroke, depending on which operating mode is better suited for a certain wire.

A device according to the invention for executing the above described process has a) a feed plane which is suitably sloped in the feed direction (i.e., for example against a wire combing device) and has a width corresponding to the wire length, b) a centrally arranged guide element which forms a control gap which is matched to the thickness of the single wire layer, and c) handling elements located on either side of the guide element which are made in the above described manner and are actuated by a suitable drive mechanism.

The strike motion can be accomplished for example by a cam drive. To guide the handling elements in linear motion over the incipient single wire layer, the cam drive can be operated perpendicularly to the wire layer with play. The strike edge thus moves by itself on the correct level. Also, instead of a cam drive, any motor drive with a suitable guide cam for the holding element can be used.

In one structurally simple embodiment, the handling elements are made as flat frames, the plane defined by the frame being perpendicular to the feed plane and parallel to the feed direction. Into the frame fit two cam disks which guide the frame such that the strike edge is always aligned parallel to the feed plane. Of course, other designs are also possible. There can be, for example, two separate drives for motion parallel to the feed plane on the one hand, and motion perpendicular to the feed plane on the other, one mechanical or control coupling being implemented which provides for the handling element in the final effect executing the desired strike motion.

The rejector advantageously executes strictly linear motion. Therefore, it can be formed, for example, by a pneumatic cylinder and a slide element guided by it. The cylinder is preferably a band cylinder (i.e., a cylinder assembly without the piston rod) since it requires little space. Other linear drives (for example, electrical, hydraulic or mechanical) can likewise be used as necessary.

With a wire length from 2 to 3 m and a diameter:length ratio of for example 1:1000, two to three groups of handling elements are used on both sides of the central guide element. Mechanical or control coupling provides phase-delayed movement of the external handling units relative to the internal ones.

To obtain the desired phase coupling of the different handling groups, there can be for example one common drive shaft which extends over the entire width of the device, and on which the cams are fixed in the desired phase position. If only 120, or 180° phase relations need be implemented, a hexagonal shaft can be used which makes angularly precise mounting of the cams very simple.

The feed plane can be formed by any bearing surface with as small a coefficient of friction as possible. A rib structure which runs in the feed direction and which is formed for example by wires which are attached to a sheet is especially advantageous.

To ensure that the separated wires can be reliably grasped by a following combing device and can be combed out without disrupting the order of the wire layer, there are preferably a large number of hold-down elements.

Other advantageous embodiments and combinations of features of the invention arise from the following detailed description and the totality of patent claims.

BRIEF DESCRIPTION OF THE DRAWINGS

The drawings used to explain the embodiment show the following.

Basically, the same parts are labelled with the same reference numbers in the figures.

EMBODIMENTS OF THE INVENTION

Figure 1:
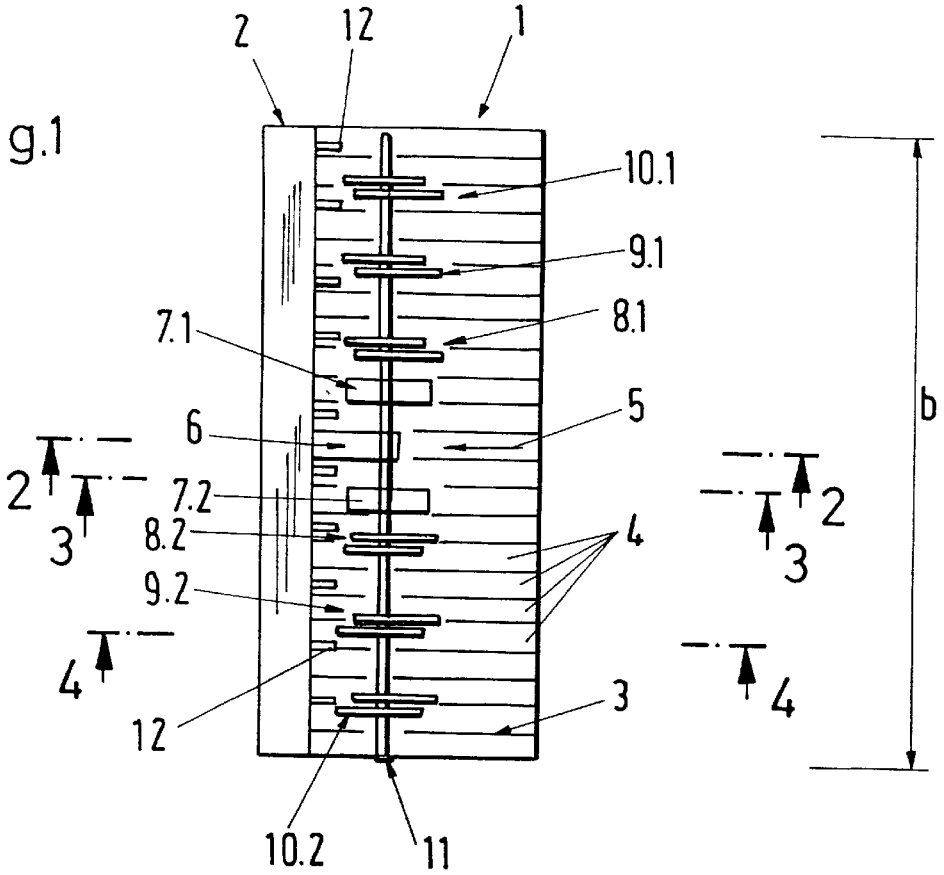
FIG. 1 shows a schematic of a device according to the present invention in an overhead view.

FIG. 1 shows separation device 1 and following combing device 2. A wire bundle is placed on feed plane 3 in order to be converted by separation device 1 into a single layer of wires. Combing device 2 combs the wires individually out of the layer and feeds them to a lattice welding machine which is not shown.

Width b of separation device 1 corresponds essentially to the length of the wires. The wire diameter is very small relative to its length. Consequently, the wires act very flexibly and can cross each other very easily. Therefore separation consists of making available a single layer without crossing wires.

Figure 2:
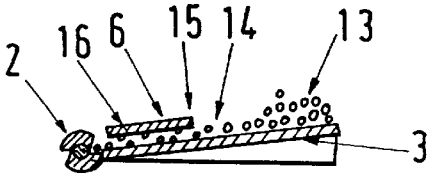
FIG. 2 shows a schematic of the central guide element in section 2—2 of FIG. 1.
Figure 3:
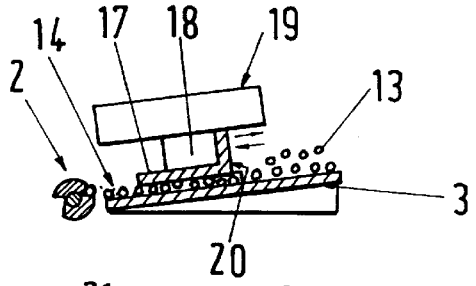
FIG. 3 shows a schematic of a rejector in section 3—3 of FIG. 1.
Figure 4:
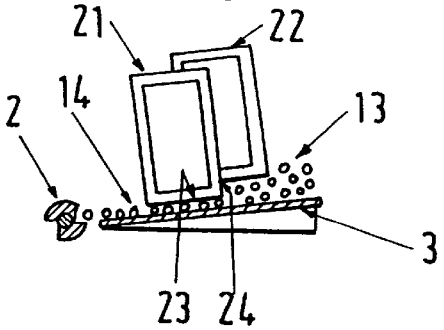
FIG. 4 shows a schematic of a handling unit consisting of two handling elements according to Section 4—4 of FIG. 1.

Feed plane 3 is sloped against combing device 2, i.e., in feed direction 5 (compare FIGS. 2 through 4). The wires of the wire bundle thus tend to move in the indicated direction under the action of gravity. Guide element 6 is placed in the middle (with reference to width b). It forms a control gap of constant height such that exactly one wire layer has room to pass with little play.

Before the wires can reach the control gap to guide element 6, they must be brought into an ordered sequence. For this purpose, in example 3 here there are pairs of handling units 8.1/8.2, 9.1/9.2, 10.1/10.2 located symmetrically to the middle. They handle the wire bundle with small repetitive motions, as will be explained in detail below.

As long as the wires are not too thin or flexible, preparation by handling units 8.1, 8.2, 9.1, 9.2, 10.1, 10.2 is enough. For very thin wires, i.e., for wires with a diameter:length ratio of 1:1000 (i.e. 0.001) and less (for example 0.0005) it is possible that the wires can be stored in a single layer by the action of handling units 8.1, 8.2, 9.1, 9.2, 10.1, 10.2, but, still be crossed in between. It is then a matter of completely removing the incorrectly arranged wires from the wire layer. This can be done with two rejectors 7.1, 7.2. They are slide-like elements which execute linear, quasi-scraping motion with high amplitude. Motion begins here underneath of the top end of guide element 6 and ends above the working area of handling units 8.1, 8.2, 9.1, 9.2, 10.1, 10.2.

It has been found in extended tests that in the embodiment shown in FIG. 1 it is enough to provide two rejectors 7.1, 7.2 which are set up between the innermost pair of handling units 8.1, 8.2 and central guide element 6.

Feed plane 3 is preferably equipped with ribs 4 which run in feed direction 5 in order to minimize the friction between the wires and the underlayer. In front of combing device 2 a larger number of hold-downs are advantageously mounted to prevent combing of the individual wires from distorting the single layer.

Finally FIG. 1 shows drive shaft 11 in outline. It extends over entire width b of separation device 1 and drives all handling units 8.1, 8.2, 9.1, 9.2, 10.1, 10.2.

FIG. 2 shows wire bundle 13 which is located in the upper area of feed plane 3 and which is converted into single wire layer 14. Since the sequence of wires in control gap 16 of guide element 6 can no longer be changed, handling units 8.1, 8.2, 9.1, 9.2, 10.1, 10.2 and rejectors 7.1, 7.2 must be placed above upper end 15 of control gap 16.

Combing device 2 can be designed in the conventional manner. For example, it has rotating wheels with recesses for transportation of individual wires.

FIG. 3 shows rejector 7.2 from the side. Slide plate 17 is moved back and forth at a constant distance (corresponding to one wire diameter) over feed plane 3. The amplitude of motion begins somewhat below upper end 15 of guide element 6 and ends in the upper area of feed plane 3 where wire bundle 13 is located. Slide plate 17 does not touch the wires as long as they do not project out of the single wire layer. Conversely, those wires which project are grasped by rejector edge 20 (which is formed on the upper end of rejector 7.2), completely removed from the wire layer, and in doing so pushed upwards into wire bundle 13.

The large motion of rejectors 7.1, 7.2 proceeds with a lower repetition rate than the small motion of handling elements 21, 22. A phase or frequency relation between the two motion sequences is unnecessary.

According to one preferred embodiment, slide plate 17 is guided or actuated by band cylinder 19. In it the motion of the piston is not transferred by a piston rod which runs in the axial direction, but by holder 18 which is guided out between bands on the longitudinal side of the cylinder. Therefore, slide plate 17 is attached to this holder 18.

FIG. 4 schematically shows handling unit 9.2 from the side. It is formed by two handling elements 21, 22 which execute a handling motion both against feed direction 5 and also perpendicular to feed plane 3. This motion has a rather small amplitude and leads to unravelling of wire bundle 13.

Each handling element 21, 22 has, as shown here on handling element 21, strike edge 23 parallel to feed plane 3 and scraping edge 24 on the upper end of strike edge 23. The latter is essentially perpendicular to feed plane 3, i.e. it is pointed towards wire bundle 13.

Figure 5:
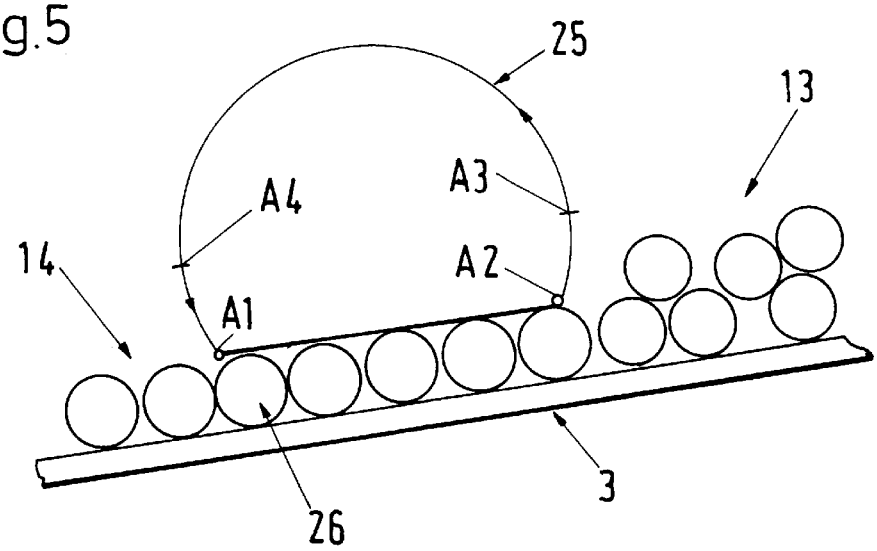
FIG. 5 shows a schematic of the motion executed by the handling elements.
Figure 6:
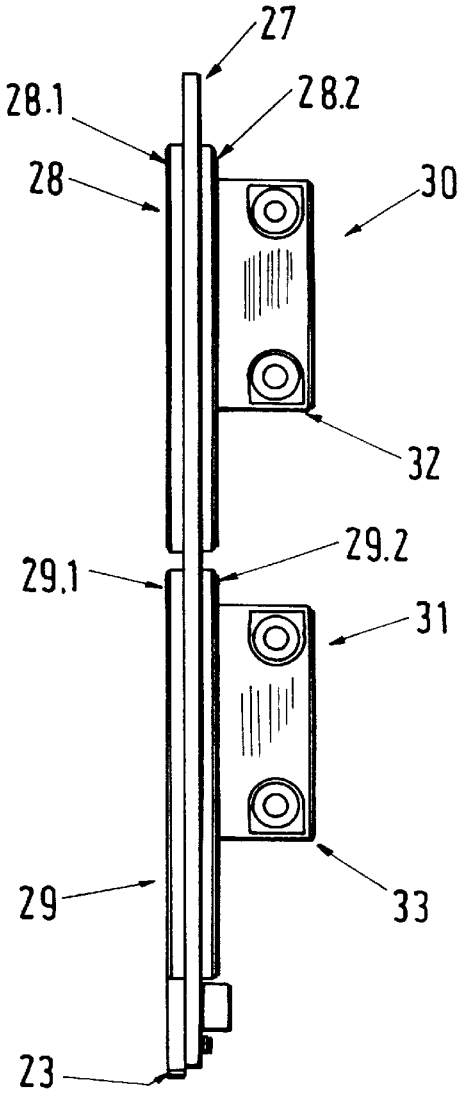
FIG. 6 shows a schematic of a handling element viewed from the front.

Using FIG. 5, how the handling unit operates will be detailed. The motion curve which is executed for example from the corner between strike edge 23 and scraping edge 24 is labelled 25. For subsequent executions, the phase position A1 is considered the starting point of motion. First a linear motion segment parallel to feed plane 3 as far as phase position A2 follows. In doing so strike edge 23 lightly touches the wires. Contact should not be too strong, to prevent the wires of the single wire layer from being pushed away from the control gap.

In phase position A2, motion curves 25 begin to distance themselves from feed plane 3. In the motion segment between A2 and A3 there is another (in this example small) motion component against feed direction 5 towards wire bundle 13. The rejected wires are therefore also raised somewhat and pushed back and up onto the wire bundle.

This is followed by arc-shaped motion through phase position A4 to starting point A1. Motion curve 25 between phase positions A2 and A1 (via A3 and A4) can be executed as an arc or in some other way. It is important that in addition to a first linear motion segment along the wire layer there is a second motion segment which at least briefly releases the wire layer.

As has already been explained using FIG. 4, one handling unit comprises at least two handling elements, for example, 21, 22. They both execute the motion shown in FIG. 5, not in the same phase position, but with a phase difference of 180°. This means that one handling unit is, for example, in phase position A4 at a certain time (and is moving toward point A1) and the other is in phase position A3 (in order to move to point A4).

Hence it follows that at certain times two handling elements 21, 22 are raised from the wire layer, but that the free space between any of the two strike edges and the wire layer is not greater than the distance between phase positions A3 and A4. This distance (which, in this case, can be selected by the distance of the center of the arc (A2/A3/A4/A1) from the wire layer or feed plane 3) is set such that a wire has room between the wire layer and the indicated phase positions A3 and A4. In this way it becomes possible to remove a wire from the lower area of wire layer 14 (for example wire 26) with rejectors 7.1, 7.2 when it is found to be lying crossed.

Using FIGS. 6 and 7*a* through 7*e* one preferred embodiment of a handling element (compare, for example, handling element 21 in FIG. 4) will be explained. The starting point is flat rectangular frame 27 which is twice as high as it is wide. It is held and guided by two cams 28, 29 located on top of one another in one plane which is perpendicular to feed plane 3 and parallel to feed direction 5. Cams 28, 29 consists essentially of two parallel spaced disks 28.1, 28.2, and 29.1, 29.2. Between them (at least along the periphery of the disks) a gap or slot is formed with a width which corresponds to the thickness of frame 27. Frame 27 is supported to move in the indicated slots.

Cams 28, 29 are each fixed with fastening device 32 or 33 on continuous drive shaft 30 or 31. As is apparent from FIG. 7*a,* the cams run synchronously so that frame 27 executes or could execute basically a rotating motion if it were not intentionally stopped in the manner described below.

As has been explained using FIG. 5, motion curve 25 is only partially, i.e., in the upper area, arc-shaped. In the lower area on the other hand it is flat or linear. In order to be able to execute it with the cam mechanism shown in FIG. 6, cams 28, 29 are forcibly guided only parallel to feed plane 3. Perpendicular to them sits frame 27 conversely with a considerable play on cams 28, 29. This play is so large that frame 27, if it lies on the wire layer in phase position A1 (compare FIG. 5), is not pressed down further, although cams 28, 29 continue to turn downward, but can slide along the wire layer. (If the wire layer were not there, frame 27 would continue to drop against the feed plane.). Therefore, a segment of the arc is more or less cut off and replaced by linear motion from A1 to A2. Starting with phase position A2, the cams again grip in the vertical direction and raise frame 27.

FIGS. 7*a* through 7*d* show how the motion of cams 28, 29 relates to the desired motion curve of strike edge 23. In the position shown in FIG. 7*a,* strike edge 23 rests over its entire length on the wire layer. The bearing pressure per wire depends on the one hand on the inherent weight of frame 27, and on the other hand, on the number of wires under strike edge 23. As was already mentioned above, the bearing pressure per wire should not be too great since otherwise the wires are moved opposite to feed direction 5 (instead of in the feed direction). It follows therefrom that strike edge 23 should have a certain minimum length (for example, 20 to 50 times the wire diameter). If the weight of frame 27 is too great or too small, the bearing pressure can be increased or decreased by controlled measures (for example, loading or unloading by spring force, attachment of additional weights, selection of a lighter or heavier material to make frame 27).

Figures 7A, 7B, 7C, 7D:
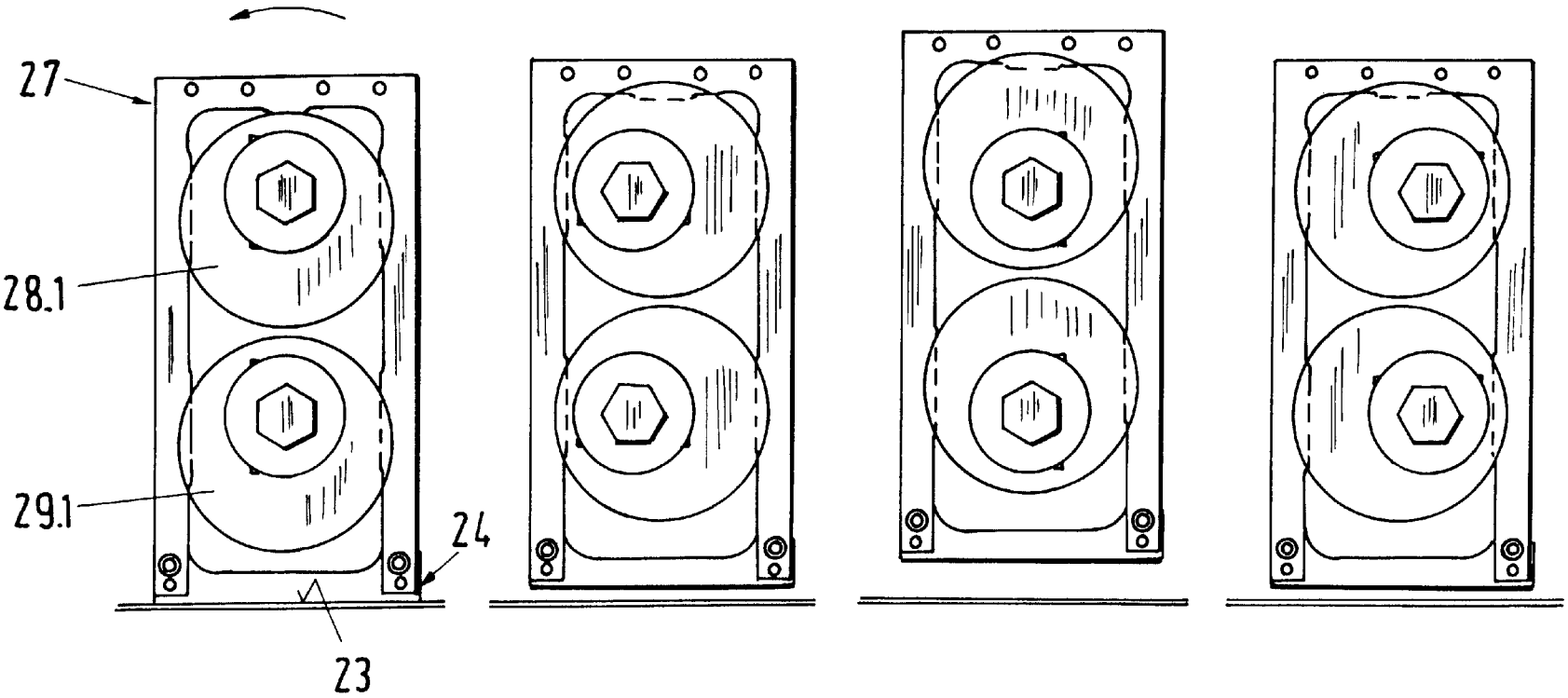
FIGS. 7*a–d* shows a representation of different positions of the handling element.

As already stated, the two handling elements of a handling unit move phase-shifted by 180°, i.e. when one element is in the position shown in FIG. 7*a,* the other is in the position shown in FIG. 7*c.* etc. If a handling unit consists of more than two frame elements, the phase shift is selected to be correspondingly small (for example, 120° for three or 90° for four elements).

According to one especially preferred embodiment, not all handling units 8.1, 8.2, 9.1, 9.2, 10.1, 10.2 (compare FIG. 1) have the same phase position. Rather, a "screw-like" manner of operation is implemented, i.e. the farther outside a handling unit is located, the more strongly it is phase-delayed. If handling units 8.1, 8.2 (which are nearest central guide element 6) run in phase position "0", handling units 9.1, 9.2 which are farther to the outside run in phase position "−120" and the outermost in phase position "−240". The wires which are not correctly arranged are therefore first in the middle and only then pushed on the ends against the wire bundle.

When separation starts, the control gap and the area of the feed plane in front of it must be manually filled beforehand. Then a first bundle can be delivered to the feed plane and the device turned on. Other wire bundles can be then supplied without interruption.

The embodiments explained using the Figures can be modified in diverse ways. Basically the number of required handling units depends on the wires to be separated.

Generally, at least four handling groups or units will be necessary. However, it is possible that in isolated cases as few as two handling groups or units will be enough.

The rejectors are optional. For wires which are not overly long (relative to diameter) they can be omitted. Although in FIG. 1 they are located between the innermost handling units and the central guide element, if necessary they can also work well positioned farther to the outside. It is also conceivable that only a single rejector will be sufficient in the center or directly next to the center.

The design of the handling elements can be completely different from the above described embodiment. Only the striking and the repeatedly lifting motion is important. The repetitive striking of the wire bundle is also an action which promotes separation. Specifically, a type of shaking motion occurs which allows the wire bundle to be successively undone and untangled.

The motion of the handling elements in any case will have a more or less straight segment. The remainder of the motion curve on the other hand can be made rather free, as long as there is raising from the wire layer.

In summary, it can be stated that the invention devises a process and a device which allow reliable separation of wires as is necessary for feed of lattice welding machines (especially for production of industrial lattices). The principle underlying the invention is of course not limited to separation assemblies for lattice welding machines. Rather other wire-like objects can also be separated.

We claim:

1. A method for separating thin, elongate members from a bundle of such members, comprising the steps of:

feeding the bundle onto an inclined feed plane in a feeding direction; and agitating the bundle so as to form a single layer of members on the feed plane, said step of agitating comprising causing a rotating handling element to move in a truncated circular path relative to the members in a plane parallel to the feeding direction and perpendicular to the feed plane, the truncated circular path including a linear portion whereby the handling member moves parallel to the feed plane and in a direction opposite to the feeding direction, the handling member being spaced from the feed plane while moving along the linear portion by a distance sufficient to permit only a single thickness of the members to pass thereby and to push back any other members layered on the single thickness of members back towards the bundle.

2. The method according to claim 1, wherein said agitating step comprises causing a pair of the rotating handling elements to move in a truncated circular path relative to the members, each handling element moving out of phase from the other handling element.

3. The method according to claim 2, wherein said agitating step comprises causing a plurality of pairs of the rotating handling elements to move in a truncated circular path relative to the members, each handling element in each pair moving out of phase from the other handling element in the pair.

4. The method according to claim 1, comprising a step of passing the single thickness of the members between a guide element spaced above the feed plane by a distance sufficient to permit only the single thickness of the members pass therebetween.

5. The method according to claim 4, wherein said agitating step comprises causing a plurality of pairs of the rotating handling elements to move in a truncated circular path relative to the members, each handling element in each pair moving out of phase from the other handling element in the pair.

6. The method according to claim 5, wherein the plurality of pairs are arranged symmetrically on respective sides of the guide element.

7. The method according to claim 4, wherein said agitating step further comprises passing the members past a rejector constructed and arranged to move reciprocally along the feeding direction so as to push any member crossing another member back into the bundle.

8. The method according to claim 7, wherein said step of passing the members past a rejector comprises passing the members past a pair of rejectors located on either side of the guide element.

9. The method according to claim 8, wherein the pair of rejectors are operated synchronously.

10. The method according to claim 8, wherein the pair of rejectors are operated in counterstroke.

11. The method according to claim 1, further comprising a step of separating respective individual members from the single thickness of members.

12. The method according to claim 11, wherein said step of separating comprises separating respective individual members from the single thickness of members using a combing device.

13. The method according to claim 1, wherein said agitating step further comprises passing the members past a rejector constructed and arranged to move reciprocally along the feeding direction so as to push any member crossing another member back into the bundle.

14. The method according to claim 1, wherein a circular portion of the truncated circular path is greater than 180°.

15. An apparatus for separating thin elongate members from a bundle of such members, comprising:

a sloped feed plane for receiving the bundle of members and guiding the members in a feeding direction along said feed plane; and a handling element constructed and arranged to agitate the bundle so as to form a single layer of members on the feed plane, said handling element being mounted and driven so as to move in a truncated circular path in a plane parallel to the feeding direction and perpendicular to said feed plane and in a direction opposite to said feeding direction, said path including a linear portion of movement parallel with said feed plane, said handling element moving along said linear portion being spaced from said feed plane by a distance sufficient to let only the single layer of members pass therebetween.

16. The apparatus according to claim 15, comprising a pair of said holding elements, each said holding element being constructed and arranged to be driven to move out of phase with the other said holding element.

17. The apparatus according to claim 16, comprising a plurality of pairs of said holding elements.

18. The apparatus according to claim 15, further comprising a guide element spaced located downstream of said handling element and being spaced from said feed plane by a distance sufficient to let only the single layer of members pass therebetween.

19. The apparatus according to claim 18, comprising a plurality of pairs of said holding elements.

20. The apparatus according to claim 19, wherein said plurality of pairs of said holding elements are arranged symmetrically on respective sides of said guide element.

21. The apparatus according to claim 18, further comprising a rejector constructed and arranged to move reciprocally along said feeding direction.

22. The apparatus according to claim 21, comprising a pair of said rejectors provided on either side of said guide element.

23. The apparatus according to claim 22, wherein said pair of rejectors is constructed and arranged to move synchronously.

24. The apparatus according to claim 22, wherein said pair of rejectors is constructed and arranged to move in counterstroke.

25. The apparatus according to claim 15, further comprising a rejector constructed and arranged to move reciprocally along said feeding direction.

26. The apparatus according to claim 15, comprising a combing device constructed and arranged to separate an individual member from said single layer of members.

27. The apparatus according to claim 26, where said combing device comprises a rotating cylinder including a groove formed therealong, whereby a single member is separated from said single layer of members by being carried away when said groove is periodically aligned with an edge of said feed plane.

28. The apparatus according to claim 15, wherein a circular portion of said truncated circular path is greater than 180°.

* * * * *